US009020381B2

(12) United States Patent
Fukuoka

(10) Patent No.: US 9,020,381 B2
(45) Date of Patent: Apr. 28, 2015

(54) IMAGE FORMING APPARATUS

(71) Applicant: KYOCERA Document Solutions Inc., Osaka-shi, Osaka (JP)

(72) Inventor: Junichi Fukuoka, Osaka (JP)

(73) Assignee: KYOCERA Document Solutions Inc. (JP)

( * ) Notice: Subject to any disclaimer, the term of this patent is extended or adjusted under 35 U.S.C. 154(b) by 131 days.

(21) Appl. No.: 13/727,343

(22) Filed: Dec. 26, 2012

(65) Prior Publication Data

US 2013/0164009 A1 Jun. 27, 2013

(30) Foreign Application Priority Data

Dec. 27, 2011 (JP) ..... 2011-286320

(51) Int. Cl.
*G03G 15/08* (2006.01)
*G03G 15/00* (2006.01)

(52) U.S. Cl.
CPC ..... *G03G 15/5008* (2013.01)

(58) Field of Classification Search
CPC ..... G03G 15/0879; G03G 2215/0888
USPC ..... 399/36, 53
See application file for complete search history.

(56) References Cited

U.S. PATENT DOCUMENTS

2011/0058827 A1* 3/2011 Maehata et al. ..... 399/39
2013/0202275 A1* 8/2013 Brown et al. ..... 388/809

FOREIGN PATENT DOCUMENTS

JP 2009-169000 7/2009

* cited by examiner

*Primary Examiner* — David Gray
*Assistant Examiner* — Michael Harrison
(74) *Attorney, Agent, or Firm* — Gerald E. Hespos; Michael J. Porco; Matthew T. Hespos

(57) ABSTRACT

Image forming apparatus is disclosed. The developing portion is replenished with toner from a toner containing body by operating a toner feeding mechanism. The receiving portion receives a designation of switching to a low speed i.e. switching the rotation speed of the motor from the first speed to the second speed lower than the first speed. The measuring portion measures a value of a counter electromotive voltage generated in the motor by causing the motor to operate the toner feeding mechanism. The motor control portion causes the motor to rotate at the first speed until an absolute value of the value measured by the measuring portion is not larger than a predetermined first value, and causes the motor to rotate at the second speed after an absolute value of the measured value is smaller than the first value, in the case where the switching to a low speed is designated.

17 Claims, 6 Drawing Sheets

IMAGE FORMING APPARATUS

This application is based on Japanese Patent Application No. 2011-286320 filed on Dec. 27, 2011, the contents of which are hereby incorporated by reference.

BACKGROUND

The present disclosure relates to an image forming apparatus configured in such a manner that a toner containing body for housing toner to be replenished to a developing portion is dismountably mounted.

When a motor is rotated, a counter electromotive voltage is generated in the motor. There has been widely known a technology of controlling rotation of a motor without a sensor by utilizing a counter electromotive voltage or a counter electromotive current derived from a counter electromotive voltage as an electrical signal.

There has been proposed an image forming apparatus applying the above technology. In such an image forming apparatus, in replenishing toner to a developer by rotating a roller (an example of a toner feeding mechanism) provided in a toner hopper as a toner containing body, a voltage higher than the voltage corresponding to a target rotation speed of the motor is supplied to the motor, while monitoring a counter electromotive voltage generated in the motor. Then, a voltage is supplied to the motor in such a manner as not to exceed the target rotation speed of the motor.

An object of the present disclosure is to provide an image forming apparatus that utilizes a counter electromotive voltage generated in a motor in operating a toner feeding mechanism provided in a toner containing body by the motor, for rotation control of the motor.

SUMMARY

An image forming apparatus according to an aspect of the present disclosure that accomplishes the above object is an image forming apparatus constructed in such a manner that a toner containing body incorporated with a toner feeding mechanism is dismountably mounted. The image forming apparatus includes a developing portion, a motor, an operation portion, a receiving portion, a measuring portion, and a motor control portion. The developing portion develops an electrostatic latent image by toner, the toner being replenished from the toner containing body by operating the toner feeding mechanism. The motor generates a rotation driving force for operating the toner feeding mechanism. The receiving portion receives a designation of switching to a low speed or switching to a high speed in response to manipulation of the operation portion, the switching to a low speed being switching a rotation speed of the motor from a first speed to a second speed lower than the first speed, the switching to a high-speed being switching the rotation speed of the motor from the first speed to a third speed higher than the first speed. The measuring portion measures a value of a counter electromotive voltage or a value of a counter electromotive current generated in the motor by causing the motor to operate the toner feeding mechanism. The motor control portion is operable to: (a) control the motor to rotate at the first speed until an absolute value of the value measured by the measuring portion becomes equal to or smaller than a predetermined first value, and control the motor to rotate at the second speed after an absolute value of the value measured by the measuring portion becomes smaller than the first value, in the case where the receiving portion receives the designation of switching to a low speed; and (b) control the motor to rotate at the first speed until an absolute value of the value measured by the measuring portion becomes equal to or smaller than a predetermined second value, and control the motor to rotate at the third speed after an absolute value of the value measured by the measuring portion becomes smaller than the second value, in the case where the receiving portion receives the designation of switching to a high speed.

An image forming apparatus according to another aspect of the present disclosure that accomplishes the above object is an image forming apparatus constructed in such a manner that a toner containing body incorporated with a toner feeding mechanism is dismountably mounted. The image forming apparatus includes a developing portion, a motor, an operation portion, a receiving portion, a measuring portion, and a motor control portion. The developing portion develops an electrostatic latent image by toner, the toner being replenished from the toner containing body by operating the toner feeding mechanism. The motor generates a rotation driving force for operating the toner feeding mechanism. The receiving portion receives a designation of switching to a low speed in response to manipulation of the operation portion, the switching to a low speed being switching a rotation speed of the motor from a first speed to a second speed lower than the first speed. The measuring portion measures a value of a counter electromotive voltage or a value of a counter electromotive current generated in the motor by causing the motor to operate the toner feeding mechanism. The motor control portion performs a speed change control of causing the motor to rotate at the first speed until an absolute value of the value measured by the measuring portion becomes equal to or smaller than a predetermined first value, and causing the motor to rotate at the second speed after an absolute value of the value measured by the measuring portion becomes smaller than the first value, in the case where the receiving portion receives the designation of switching to a low speed.

An image forming apparatus according to yet aspect of the present disclosure that accomplishes the above object is an image forming apparatus constructed in such a manner that a toner containing body incorporated with a toner feeding mechanism is dismountably mounted. The image forming apparatus includes a developing portion, a motor, an operation portion, a receiving portion, a measuring portion, and a motor control portion. The developing portion develops an electrostatic latent image by toner, the toner being replenished from the toner containing body by operating the toner feeding mechanism. The motor generates a rotation driving force for operating the toner feeding mechanism. The receiving portion receives a designation of switching to a high speed in response to manipulation of the operation portion, the switching to a high speed being switching a rotation speed of the motor from a first speed to a third speed higher than the first speed. The measuring portion measures a value of a counter electromotive voltage or a value of a counter electromotive current generated in the motor by causing the motor to operate the toner feeding mechanism. The motor control portion performs a speed change control of causing the motor to rotate at the first speed until an absolute value of the value measured by the measuring portion becomes equal to or smaller than a predetermined second value, and causing the motor to rotate at the third speed after an absolute value of the value measured by the measuring portion becomes smaller than the second value, in the case where the receiving portion receives the designation of switching to a high speed.

These and other objects, features and advantages of the present disclosure will become more apparent upon reading the following detailed description along with the accompanying drawings.

DETAILED DESCRIPTION

Figure 1:
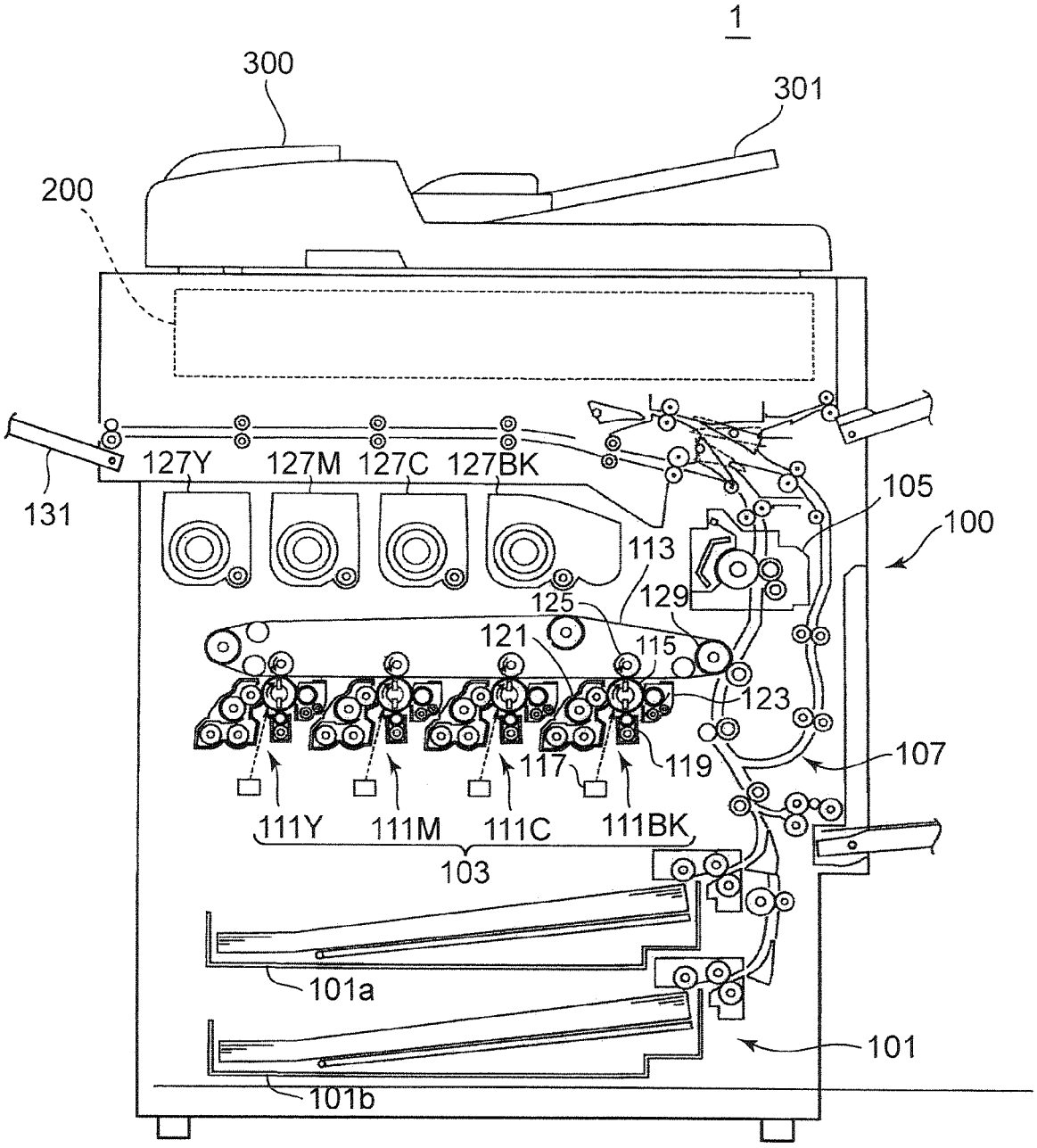
FIG. 1 is a diagram schematically showing an internal structure of an image forming apparatus embodying the present disclosure.

In the following, an embodiment of the present disclosure is described in detail referring to the drawings. FIG. 1 is a diagram schematically showing an internal structure of an image forming apparatus 1 embodying the present disclosure. The image forming apparatus 1 may be applied to a digital complex machine having the functions of e.g. a copier, a printer, a scanner, and a facsimile machine. The image forming apparatus 1 is provided with an apparatus main body 100, a document reading portion 200, and a document feeding portion 300.

The document reading portion 200 is disposed above the apparatus main body 100, and the document feeding portion 300 is disposed above the document feeding portion 200.

The document feeding portion 300 functions as an automatic document feeder, and is configured to feed a number of documents placed on a document setting portion 301 in such a manner that the document reading portion 200 can sequentially read the documents.

The document reading portion 200 is provided with a carriage loaded with e.g. an exposure lamp, a document holder constituted of a transparent member such as a glass member, a CCD (Charge Coupled Device) sensor, and a document reading slit, all of which are not shown in the drawings. The CCD sensor outputs a read document as image data.

The apparatus main body 100 is provided with a sheet storage portion 101, an image forming portion 103, and a fixing portion 105. The sheet storage portion 101 is disposed at a lowermost position of the apparatus main body 100, and is provided with two sheet cassettes 101*a* and 101*b*, each of which can store a stack of sheets.

Out of the sheet cassettes 101*a* and 101*b*, an uppermost sheet of a sheet stack stored in the selected cassette is fed toward a sheet transport path 107 of the apparatus main body 100 by driving a pickup roller (not shown). The sheet is transported to the image forming portion 103 along the sheet transport path 107.

The sheet transport path 107 extends substantially vertically upward along one surface (the right surface in FIG. 1) of the apparatus main body 100, is bent at an upper position in the apparatus main body 100 toward the other surface (the left side in FIG. 1) of the apparatus main body, and extends substantially horizontally toward a position beneath the document reading portion 200. A discharge tray 131 is disposed at an end of the sheet transport path 107.

The image forming portion 103 forms a toner image on a transported sheet. The image forming portion 103 is provided with a yellow image forming unit 111Y, a magenta image forming unit 111M, a cyan image forming unit 111C, and a black image forming unit 111BK, which are disposed in the order of transferring toner images onto a transfer belt 113. The arrangement of the color image forming unit is the same between the color image forming units 111Y, 111M, 111C, and 111BK. In the following, the arrangement of the color image forming unit is described by taking an example of the black image forming unit 111BK.

The black image forming unit 111BK is provided with a photosensitive drum 115 and an exposure portion 117. A charger 119, a developing portion 121, and a cleaning portion 123 are disposed around the photosensitive drum 115. The charger 119 uniformly charges the circumferential surface of the photosensitive drum 115. The exposure portion 117 generates a light beam which is modulated in accordance with image data (such as image data outputted from the document reading portion 200, image data transmitted from a personal computer, or image data received by facsimile transmission), and radiates the uniformly charged circumferential surface of the photosensitive drum 115. By performing the above operation, an electrostatic latent image corresponding to black image data is formed on the circumferential surface of the photosensitive drum 115. By supplying black toner from the developing portion 121 onto the circumferential surface of the photosensitive drum 115 in the above state, a toner image corresponding to black image data is formed on the circumferential surface of the photosensitive drum 115.

The transfer belt 113 is movable counterclockwise in a state that the transfer belt 113 is interposed between the photosensitive drum 115 and a primary transfer roller 125. A black toner image formed on the circumferential surface of the photosensitive drum 115 is transferred from the photosensitive drum 115 to the transfer belt 113. Black toner residues on the circumferential surface of the photosensitive drum 115 are removed by the cleaning portion 123. The above is the explanation regarding the black image forming unit 111BK.

Containers for storing the respective color toners, in other words, a container 127Y for storing yellow toner, a container 127M for storing magenta toner, a container 127Y for storing cyan toner, and a container 127BK for storing black toner are disposed above the yellow image forming unit 111Y, the magenta image forming unit 111M, the cyan image forming unit 111C, and the black image forming unit 111BK, respectively. Toner of each respective color is replenished from each respective container to each respective color developing portion 121.

As described above, a yellow toner image is transferred to the transfer belt 113, and then, a magenta toner image is transferred onto the yellow toner image. Likewise, a cyan toner image and a black toner image are successively transferred one over the other. By performing the transfer operation as described above, a full-color tonner image is formed on the transfer belt 113. By transferring toner images of the respective color patterns one over the other onto the transfer belt 113, a full-color toner image is formed on the transfer belt 113. The full-color toner image is transferred onto the sheet that has been transported from the sheet storage portion 101 as described above, by a secondary transfer roller 129.

The sheet carrying a transferred color toner image thereon is fed to the fixing portion 105. The fixing portion 105 is provided with a heating roller and a fixing roller. The sheet carrying the transferred color toner image is held between the heating roller and the fixing roller. By performing the above operation, heat and pressure are applied to both of the color toner image and the sheet, whereby the color toner image is fixed onto the sheet. The sheet is then discharged onto the discharge tray 131.

Figure 2:
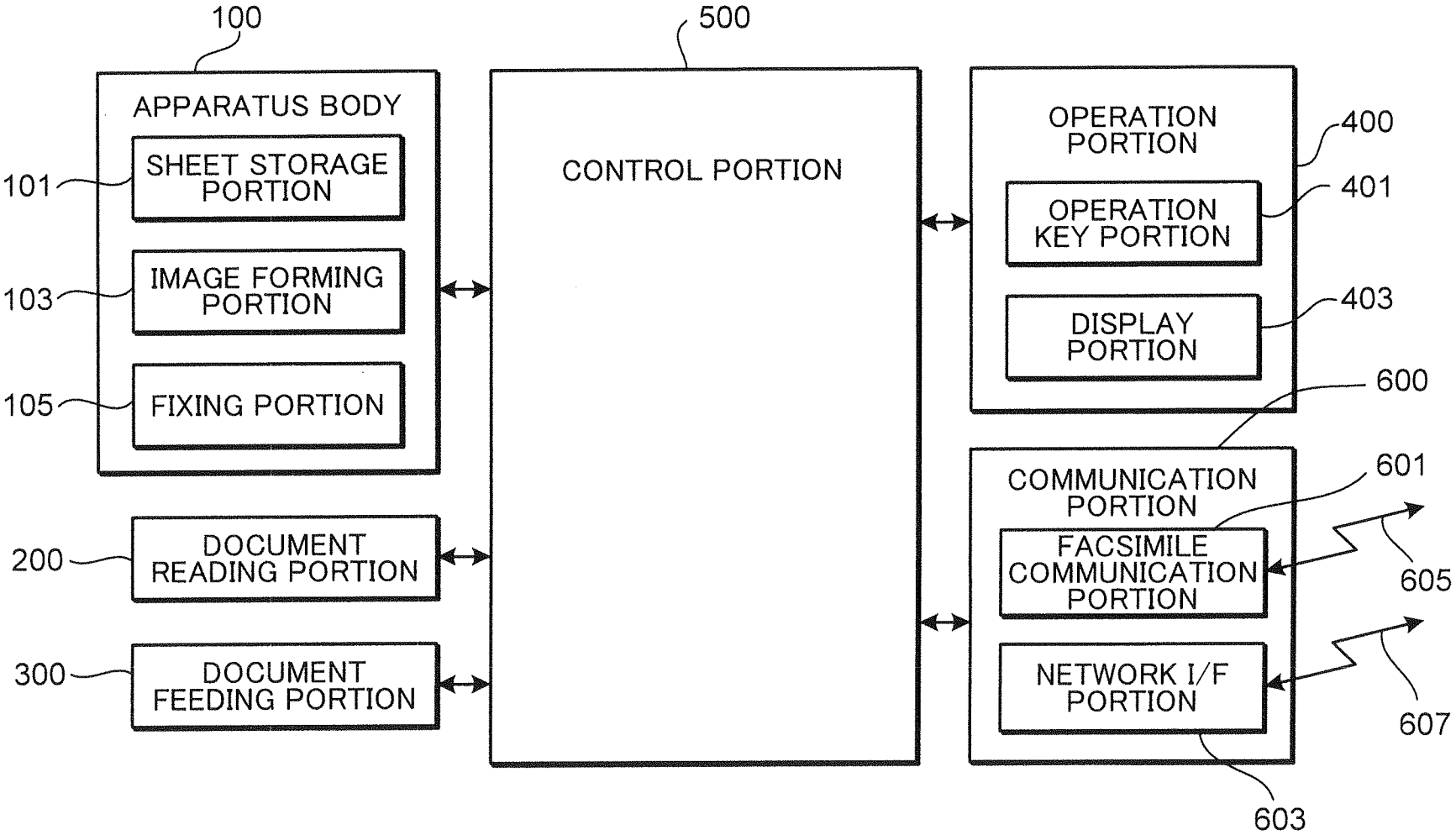
FIG. 2 is a block diagram showing an arrangement of the image forming apparatus shown in FIG. 1.

FIG. 2 is a block diagram showing a configuration of the image forming apparatus 1 shown in FIG. 1. The image forming apparatus 1 has such a configuration that the apparatus main body 100, the document reading portion 200, the document feeding portion 300, an operation portion 400, a control portion 500, and a communication portion 600 are connected to each other by a bus. Since the apparatus main body 100, the document reading portion 200, and the document feeding portion 300 have been described in the foregoing section, repeated description thereof is omitted herein.

The operation portion 400 is provided with an operation key portion 401 and a display portion 403. The display portion 403 has a touch panel function, and a screen including soft keys is displayed on the display portion 403. The user is allowed to perform e.g. settings necessary for execution of the functions such as a copying function by manipulating the soft keys while viewing the screen.

The operation key portion 401 has operation keys constituted of hard keys. Examples of the hard keys are a start key; a ten key; a stop key; a reset key; and a function switching key for allowing the user to switch the functions between a copier, a printer, a scanner, and a facsimile machine.

The start key is a key for allowing the user to start an operation such as copying or facsimile transmission. The ten key is a key for allowing the user to input the numbers such as the number of copies or a facsimile number. The stop key is a key for allowing the user to suspend an operation such as a copying operation. The reset key is a key for allowing the user to return the designated contents to an initially set condition.

The function switching key is provided with e.g. a copy key and a facsimile transmission key. The function switching key is a key for allowing the user to switch the functions between a copying function and a facsimile transmission function, for instance. In response to user's manipulation of the copy key, an initial screen for enabling copying is displayed on the display portion 403. In response to user's manipulation of the facsimile transmission key, an initial screen for enabling facsimile transmission and e-mail transmission is displayed on the display portion 403.

The control portion 500 is constituted of a CPU (Central Processing Unit), an ROM (Read Only Memory), an RAM (Random Access Memory), and an image memory. The CPU implements controls for the constituent elements of the image forming apparatus 1 such as the apparatus main body 100, which are necessary for operating the image forming apparatus 1. The ROM stores software components necessary for controlling the operation of the image forming apparatus 1. The RAM is used for temporarily storing data generated in execution of software components, and for storing software applications. The image memory temporarily stores image data (such as image data outputted from the document reading portion 200, image data transmitted from a personal computer, or image data received by facsimile transmission).

The communication portion 600 is provided with a facsimile communication portion 601 and a network I/F portion 603. The facsimile communication portion 601 is provided with an NCU (Network Control Unit) for controlling connection to the telephone line of a facsimile machine for facsimile communication, and a modulation/demodulation circuit for modulating/demodulating a signal for use in facsimile communication. The facsimile communication portion 601 is connected to a telephone line 605.

The network I/F portion 603 is connected to an LAN (Local Area Network) 607. The network I/F portion 603 is a communication interface circuit for executing communication with a terminal device such as a personal computer which is connected to the LAN 607.

Figure 3:
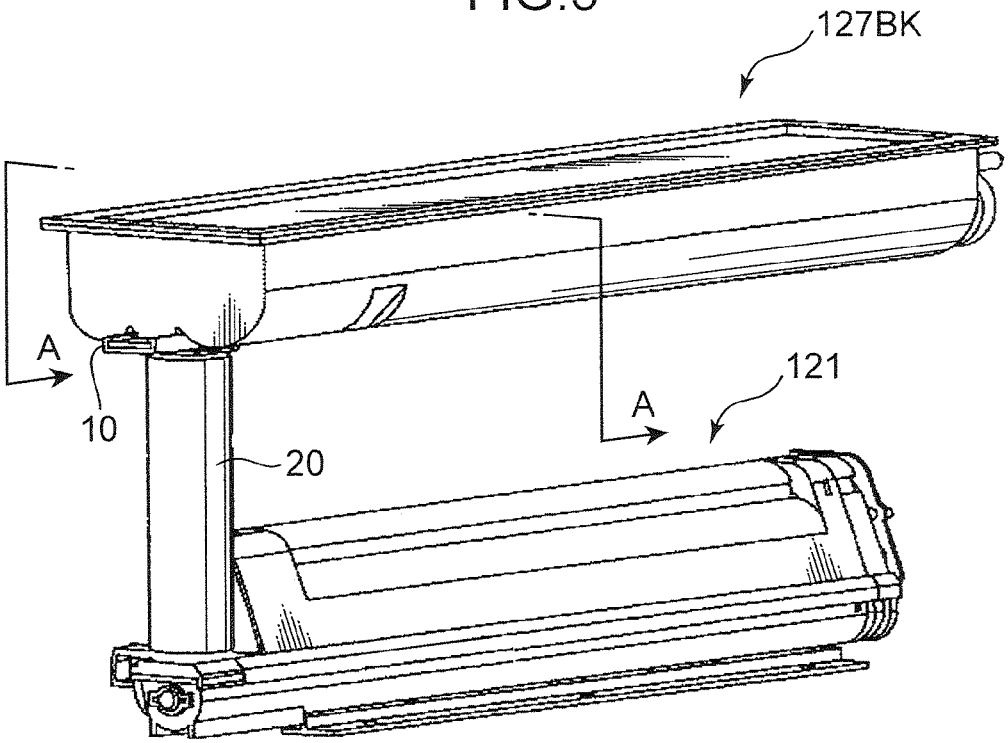
FIG. 3 is a perspective view showing a positional relationship between a developing portion and a container for black toner in the embodiment.
Figure 4:
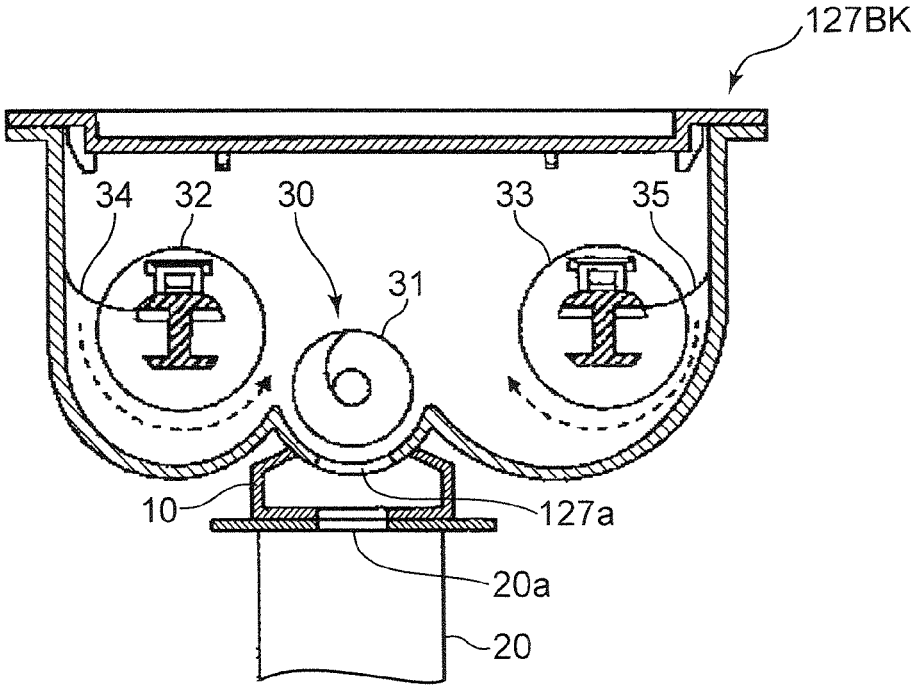
FIG. 4 is a cross-sectional view of the container shown in FIG. 3, taken along the line A-A in FIG. 3.

Next, a mechanism for replenishing toner from a toner container (an example of the toner container body) to a developing portion 121 is described. The toner replenishing mechanism is the same between the color image forming units 111Y, 111M, 111C, and 111BK. In the following, the toner replenishing mechanism is described by taking an example of the black image forming unit 111BK. FIG. 3 is a perspective view showing a positional relationship between the developing portion 121 and the container 127BK for black toner. FIG. 4 is a cross-sectional view of the container 127BK shown in FIG. 3, taken along the line A-A in FIG. 3.

The black toner container 127BK is dismountably mounted to the image forming apparatus 1. More specifically, in the case where the container 127BK is mounted in the image forming apparatus 1, the container 127BK is slidably moved from the front side of the image forming apparatus 1 toward the back side thereof along a guide rail 10 provided in the image forming apparatus 1. In the case where the container 127BK is properly mounted in the image forming apparatus 1, a toner supply port 127*a* formed in a bottom surface of the container 127BK faces an upper end port 20*a* of a toner replenishing path 20. The toner replenishing path 20 serves as a passage along which black toner in the container 127BK that is mounted in the image forming apparatus 1 is replenished to the developing portion 121. The toner replenishing path 20 has a tubular shape, and a lower end port (not shown) thereof is communicated with the interior of the developing portion 121. With this arrangement, black toner in the container 127BK is replenishable to the developing portion 121 via the toner replenishing path 20. The transfer belt 113 shown in FIG. 1 is located between the developing portion 121 and the container 127BK. The toner replenishing path 20 is located on the side of the transfer belt 113.

In the case where the container 127BK is dismounted from the image forming apparatus 1, the user is allowed to dismount the container 127BK from the image forming apparatus 1 by slidably moving the container 127BK from the back side of the image forming apparatus 1 toward the front side thereof along the guide rail 10.

As shown in FIG. 4, a toner feeding mechanism 30 is disposed in the container 127BK. The toner feeding mechanism 30 is provided with a screw conveyor 31, and two agitation rollers 32 and 33. Rotation driving forces of the screw conveyor 31, and the agitation rollers 32 and 33 are transmitted by a motor 41 to be described later referring to FIG. 5. By performing the above operation, the screw conveyor 31, and the agitation rollers 32 and 33 are rotated about an axis extending in the longitudinal direction (in other words, in a direction from the front side of the image forming apparatus 1 toward the back side thereof) of the container 127BK.

The agitation rollers 32 and 33 are disposed on both sides of the screw conveyor 31. Referring to FIG. 4, the agitation roller 32 is disposed on the left side of the screw conveyor 31, and the agitation roller 33 is disposed on the right side of the screw conveyor 31. The agitation roller 32 is rotatable counterclockwise, and the agitation roller 33 is rotatable clockwise.

The agitation roller 32 is provided with an agitation blade 34 projecting in the circumferential direction of the agitation roller 32. The agitation roller 33 is provided with an agitation blade 35 projecting in the circumferential direction of the agitation roller 33. When the agitation rollers 32 and 33 are rotated, black toner in the container 127BK is supplied to the screw conveyor 31 while being agitated by the agitation blades 34 and 35. The screw conveyor 31 feeds the supplied black toner to the toner replenishing path 20 while being rotated in a certain direction. By performing the above operation, black toner is replenished to the developing portion 121 via the toner replenishing path 20.

Figure 5:
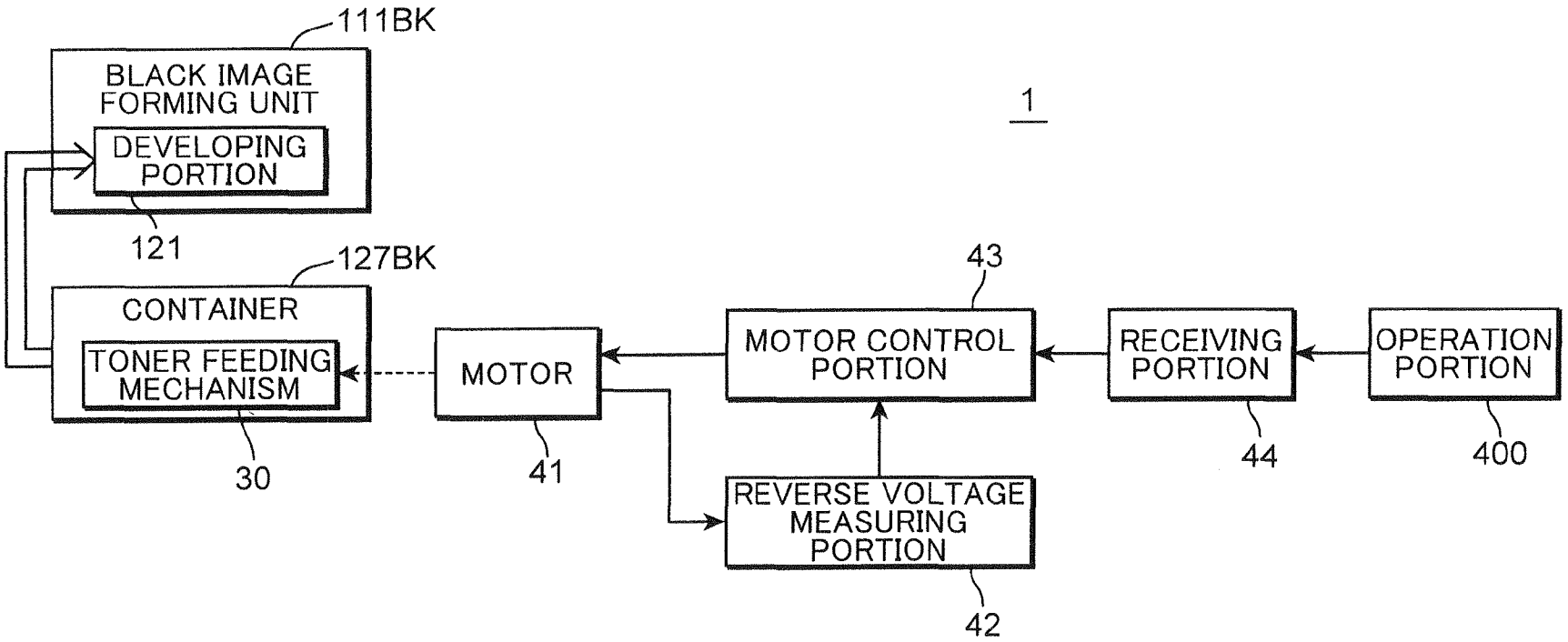
FIG. 5 is a block diagram showing a configuration for controlling a toner feeding mechanism.

Next, an arrangement for controlling the toner feeding mechanism 30 is described. The arrangement is the same between the color image forming units 111Y, 111M, 111C, and 111BK. The arrangement is described by taking an example of the black image forming unit 111BK. FIG. 5 is a block diagram showing an arrangement for controlling the toner feeding mechanism 30.

The image forming apparatus 1 is provided with the black image forming unit 111BK including the developing portion 121, a motor 41, a counter electromotive voltage measuring portion 42, a motor control portion 43, a receiving portion 44, and the operation portion 400.

The motor 41 is a DC brush motor. The motor 41 generates a rotation driving force for operating the toner feeding mechanism 30 provided in the container 127BK.

In the case where the amount of black toner in the container 127BK is decreased, a resistance by black toner acting on the screw conveyor 31 and on the agitation rollers 32 and 33 (see FIG. 4) is decreased. Accordingly, in the case where the rotation speed of the motor 41 is set constant, a decrease in the amount of black toner in the container 127BK results in a decrease in the absolute value of the value of a counter electromotive voltage generated in the motor 41. For instance, in a state that the amount of black toner in the container 127BK is large, and the screw conveyor 31 and peripheral parts thereof are buried in the black toner, the absolute value of the value of a counter electromotive voltage generated in the motor 41 is increased, because the resistance acting on the screw conveyor 31 and on the peripheral parts thereof is large. On the other hand, in a state that the amount of black toner in the container 127BK is small, and the screw conveyor 31 and peripheral parts thereof are exposed from the toner, the absolute value of the value of a counter electromotive voltage generated in the motor 41 is decreased, because the resistance acting on the screw conveyor 31 and on the peripheral parts thereof is small.

A decrease in the amount of toner in the container 127BK results in a decrease in load torque of the motor 41. This widens the rotation speed range within which the motor 41 is caused to stably rotate in operating the toner feeding mechanism 30.

In view of the above, the embodiment is configured in such a manner that the user is allowed to designate switching to a low speed or switching to a high speed, regarding the rotation speed of the motor 41 by manipulating the operation portion 400. Specifically, the motor 41 is caused to rotate at a first speed from the time when the black toner in the container 127BK is full until the amount of black toner in the container 127BK is decreased to some degree. A decrease in the amount of black toner in the container 127BK results in a decrease in load torque of the motor 41. In response to lowering of the absolute value of the value of a counter electromotive voltage generated in the motor 41 than a predetermined value, the rotation speed of the motor 41 is changed depending on whether switching to a low speed or switching to a high speed is designated. In the case where switching to a low speed is designated, the predetermined value is a first value, and in the case where switching to a high speed is designated, the predetermined value is a second value. In the case where switching to a low speed is designated, the motor 41 is caused to rotate at a second speed lower than the first speed. In the case where switching to a high speed is designated, the motor 41 is caused to rotate at a third speed higher than the first speed. The first value and the second value may be different from each other, or may be the same as each other.

In the case where switching to a low speed is designated, the rotation speed of the motor 41 is lowered. Accordingly, it is possible to reduce noise resulting from rotation of the motor 41. In particular, noise is large in a DC brush motor, as compared with a stepping motor. Accordingly, the embodiment is advantageous in the case where a DC brush motor is used as the motor 41. In the case where switching to a high speed is designated, it is possible to enhance the speed of replenishing black toner to the developing portion 121. This is advantageous in performing high-speed printing.

The value for use in determining whether the rotation speed of a motor is switched from the first speed to the second speed or from the first speed to the third speed is described by taking an example of the value of a counter electromotive voltage generated in the motor. Alternatively, it is possible to use a value of a counter electromotive current derived from a counter electromotive voltage generated in a motor.

The receiving portion 44 receives designation of switching to a low speed i.e. switching the rotation speed of the motor 41 from the first speed to the second speed lower than the first speed, or designation of switching to a high speed i.e. switching the rotation speed of the motor 41 from the first speed to the third speed higher than the first speed, in response to user's manipulation of the operation portion 400. The receiving portion 44 is implemented by a CPU, an ROM, and an RAM which constitute the control portion 500.

The counter electromotive voltage measuring portion 42 is an example of a measuring portion. The counter electromotive voltage measuring portion 42 measures the value of a counter electromotive voltage generated in the motor 41 by causing the motor 41 to operate the toner feeding mechanism 30.

The motor control portion 43 performs the following controls (a) and (b).

(a) In the case where the receiving portion 44 receives a designation of switching to a low speed, the motor control portion 43 causes the motor 41 to rotate at the first speed until the absolute value of a counter electromotive voltage value measured by the counter electromotive voltage measuring portion 42 becomes equal to or smaller than the predetermined first value. Then, the motor control portion 43 causes the motor 41 to rotate at the second speed after the absolute value of a counter electromotive voltage value measured by the counter electromotive voltage measuring portion 42 is smaller than the first value.

(b) On the other hand, in the case where the receiving portion 44 receives a designation of switching to a high speed, the motor control portion 43 causes the motor 41 to rotate at the first speed until the absolute value of a counter electromotive voltage value measured by the counter electromotive voltage measuring portion 42 becomes equal to or smaller than the predetermined second value. Then, the motor control portion 43 causes the motor 41 to rotate at the third speed after the absolute value of a counter electromotive voltage value measured by the counter electromotive voltage measuring portion 42 is smaller than the second value.

Figure 6:
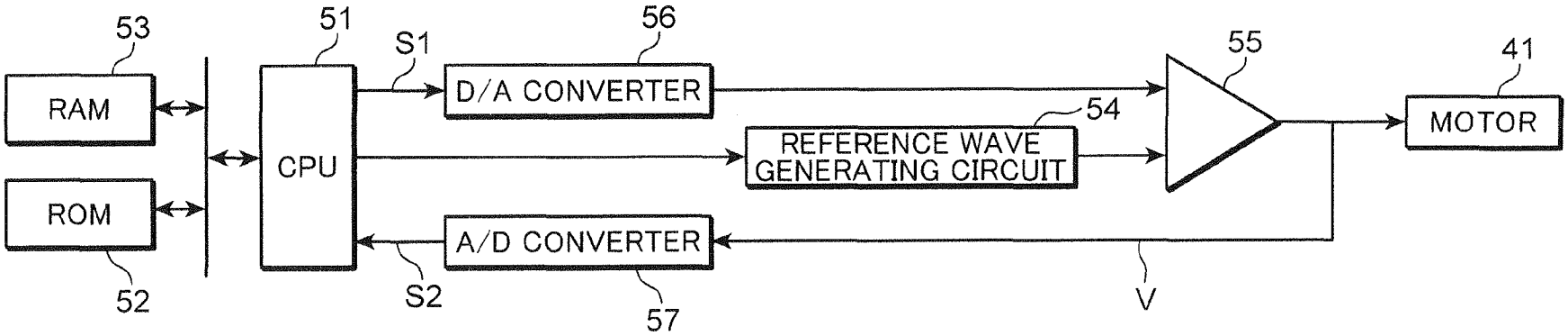
FIG. 6 is a diagram showing an example of a configuration of a circuit block for implementing a counter electromotive voltage measuring portion and a motor control portion.

FIG. 6 is a diagram showing an example of a configuration of a circuit block for implementing the counter electromotive voltage measuring portion 42 and the motor control portion 43. In this embodiment, the rotation speed of the motor 41 is controlled by PWM control. A CPU 51, an ROM 52, and an RAM 53 are the elements constituting the control portion 500 (see FIG. 2). A voltage to be applied to the motor 41 is not limited to a PWM wave, but may be a direct-current voltage.

A reference wave generating circuit 54 generates a triangular wave. The triangular wave generated by the reference wave generating circuit 54 is inputted to an input terminal of a comparator 55.

A digital electrical signal S1 indicating the value of a DC voltage outputted from the CPU 51 is converted into an analog electrical signal S1 by a DA converter 56, and the analog electrical signal S1 is inputted to the other input terminal of the comparator 55. A PWM pulse to be outputted from the comparator 55 is supplied to the motor 41, whereby the motor 41 is rotated. It is possible to change the duty ratio of a PWM pulse to be outputted from the comparator 55 in accordance with a DC voltage represented by the electrical signal S1. The rotation speed of the motor 41 is controlled with use of a change in the duty ratio.

A counter electromotive voltage V generated in the motor 41 is converted into a digital electrical signal S2 by an A/D converter 57, and the digital electrical signal S2 is inputted to the CPU 51. The value of the counter electromotive voltage V generated in the motor 41 is constantly fed back to the CPU 51. The motor 41 is caused to rotate at the first speed until the value of the counter electromotive voltage V generated in the motor 41 becomes equal to or smaller than the predetermined value. In the case where switching to a low speed is designated, the predetermined value is the first value, and in the case where switching to a high speed is designated, the predetermined value is the second value. The motor 41 is caused to rotate at the second speed or the third speed after the value of the counter electromotive voltage V generated in the motor 41 is smaller than the predetermined value.

Figure 7:
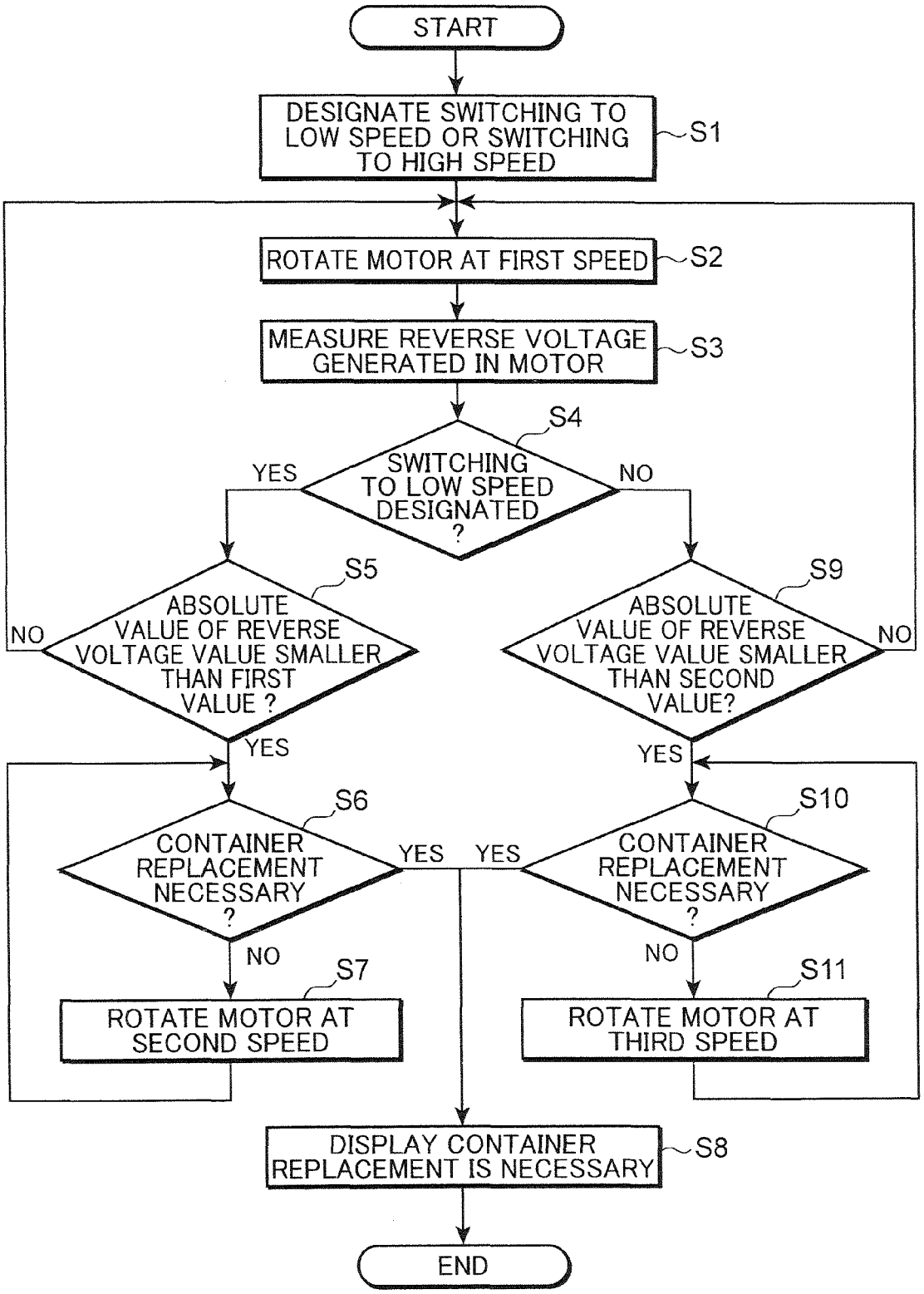
FIG. 7 is a flowchart for describing a control of replenishing black toner from a black toner container to a developing portion in the embodiment.

Next, a control of replenishing toner from a toner container to a developing portion 121 in this embodiment is described. The control is the same between the color image forming units 111Y, 111M, 111C, and 111BK. The control is described by taking an example of the black image forming unit 111BK referring to FIG. 5 and FIG. 7. FIG. 7 is a flowchart for describing the control.

A user or a serviceperson is allowed to designate switching to a low speed or switching to a high speed, regarding speed change control of the motor 41, by manipulating the operation portion 400 (Step S1).

In the case where switching to a low speed is designated, the rotation speed of the motor 41 is initially set to the first speed, and in response to a decrease in the amount of black toner in the container 127BK to some degree, the rotation speed of the motor 41 is switched from the first speed to the second speed lower than the first speed. In the case where switching to a high speed is designated, the rotation speed of the motor 41 is initially set to the first speed, and in response to a decrease in the amount of black toner in the container 127BK to some degree, the rotation speed of the motor 41 is switched from the first speed to the third speed higher than the first speed. In the case where neither switching to a low speed nor switching to a high speed is designated, the rotation speed of the motor 41 is set to the first speed, and then is retained unchanged, even if the amount of black toner in the container 127BK is decreased.

In the case where the image forming apparatus is in a normal operation mode, which is the mode other than energy saving mode such as sleep mode, the motor control portion 43 causes the motor 41 to rotate for operating the toner feeding mechanism 30. The motor control portion 43 causes the motor 41 to rotate at the first speed from the time when the black toner in the container 127BK is full until the amount of black toner in the container 127BK is decreased to some degree (Step S2).

The counter electromotive voltage measuring portion 42 measures a value of a counter electromotive voltage generated in the motor 41 which is caused to rotate in Step S2 (Step S3). Then, the motor control portion 43 determines whether switching to a low speed is designated in Step S1 (Step S4).

In the case where the motor control portion 43 determines that switching to a low speed is designated (YES in Step S4), the motor control portion 43 determines whether the absolute value of a counter electromotive voltage value measured by the counter electromotive voltage measuring portion 42 in Step S3 is smaller than the predetermined first value, resulting from a decrease in the amount of black toner in the container 127BK (Step S5). In the case where the motor control portion 43 determines that the absolute value of the measured counter electromotive voltage value is not smaller than the first value (NO in Step S5), the control returns to Step S2 to cause the motor 41 to rotate at the first speed.

In the case where the motor control portion 43 determines that the absolute value of the measured counter electromotive voltage value is smaller than the first value (YES in Step S5), the motor control portion 43 determines whether the control portion 500 has made determination as to whether replacement of the container 127BK is necessary, resulting from a decrease in the amount of black toner in the container 127BK (Step S6).

In the case where the control portion 500 determines that replacement of the container 127BK is necessary (YES in Step S6), the control portion 500 causes the display portion 400 (see FIG. 2) to display an image indicating that the container 127BK is replaced (Step S8).

In the case where the control portion 500 determines that replacement of the container 127BK is not necessary (NO in Step S6), the motor control portion 43 switches the rotation speed of the motor 41 from the first speed to the second speed (Step S7), and the control returns to Step S6.

On the other hand, in the case where the motor control portion 43 determines that switching to a low speed is not designated in Step S1 (NO in Step S4), in other words, in the case where switching to a high speed is designated, the control proceeds to Step S9.

Then, the motor control portion 43 determines whether the absolute value of a counter electromotive voltage value measured by the counter electromotive voltage measuring portion 42 in Step S3 is smaller than the predetermined second value, resulting from a decrease in the amount of black toner in the container 127BK (Step S9). In the case where the motor control portion 43 determines that the absolute value of the measured counter electromotive voltage value is not smaller than the second value (NO in Step S9), the control returns to Step S2, and the motor 41 is caused to rotate at the first speed.

In the case where the motor control portion 43 determines that the absolute value of the measured counter electromotive voltage value is smaller than the second value (YES in Step S9), the motor control portion 43 determines whether the control portion 500 has made determination as to whether replacement of the container 127BK is necessary, resulting from a decrease in the amount of black toner in the container 127BK (Step S10).

In the case where the control portion 500 determines that replacement of the container 127BK is necessary (YES in Step S10), the control proceeds to Step S8.

In the case where the control portion 500 determines that replacement of the container 127BK is not necessary (NO in Step S10), the motor control portion 43 switches the rotation speed of the motor 41 from the first speed to the third speed (Step S11), and the control returns to Step S10.

The following is the main advantages of the embodiment. A decrease in the amount of black toner in the container 127BK results in a decrease in load torque of the motor 41. This increases the rotation speed range within which the motor 41 is allowed to stably rotate in operating the toner feeding mechanism 30. According to the embodiment, the user is allowed to designate switching to a low speed or switching to a high speed, regarding the rotation speed of the motor 41, by manipulating the operation portion 400 (Step S1).

In the case where switching to a low speed is designated, and a predetermined condition is satisfied (YES in Step S5, and NO in Step S6), the rotation speed of the motor 41 is decreased from the first speed to the second speed. This is advantageous in suppressing noise resulting from rotation of the motor 41. On the other hand, in the case where switching to a high speed is designated, and a predetermined condition is satisfied (YES in Step S9, and NO in Step S10), the rotation speed of the motor 41 is increased from the first speed to the third speed. This enhances the speed of replenishing toner to the developing portion 121, which is advantageous in performing high-speed printing.

As described above, according to the embodiment, it is possible to provide the image forming apparatus 1 that utilizes a counter electromotive voltage generated in the motor 41 in operating the toner feeding mechanism 30 provided in the container 127BK by the motor 41, for rotation control of the motor 41.

In the following, first through fourth modifications of the embodiment are described. The first modification is as follows. The image forming apparatus is further provided with a first storage portion which stores in advance data in which the value of a counter electromotive voltage and the second speed are correlated with each other in such a manner as to satisfy a relation that the second speed decreases, as the absolute value of a counter electromotive voltage value measured by the counter electromotive voltage measuring portion 42 decreases. The motor control portion 43 performs a speed change control of decreasing the second speed after the absolute value of a counter electromotive voltage value measured by the counter electromotive voltage measuring portion 42 is smaller than the first value, with use of the data stored in the first storage portion and the counter electromotive voltage value measured by the counter electromotive voltage measuring portion 42, in the case where the receiving portion 44 receives a designation of switching to a low speed.

Now, let us consider a configuration of switching the rotation speed of the motor 41 from the first speed to the second speed, and thereafter, retaining the second speed unchanged. By switching the rotation speed of the motor 41 to the second speed in a state that the amount of black toner in the container 127BK is large, it is possible to obtain an effect of reducing noise resulting from rotation of the motor 41 from the state that the amount of black toner in the container 127BK is large. This is advantageous in extending the period for obtaining the effect. However, since load torque of the motor 41 is large in a state that the amount of black toner in the container 127BK is large, it is impossible or difficult to decrease the second speed in the state that the amount of black toner in the container 127BK is large. Thus, it is impossible to significantly reduce noise resulting from rotation of the motor 41.

On the other hand, in the case where the rotation speed of the motor 41 is switched to the second speed in a state that the amount of black toner in the container 127BK is small, load torque of the motor 41 is small in the state that the amount of black toner in the container 127BK is small. Accordingly, it is possible to decrease the second speed, which makes it possible to greatly suppress noise resulting from rotation of the motor 41. However, the period for obtaining the effect of suppressing noise resulting from rotation of the motor 41 is short, because the effect is obtained only after the amount of black toner in the container 127BK is decreased to a certain degree.

In contrast, according to the first modification, it is possible to stepwise decrease the second speed, as the absolute value of a counter electromotive voltage value measured by the counter electromotive voltage measuring portion 42 is decreased. Accordingly, it is possible to switch the rotation speed of the motor 41 to the second speed from a state that the amount of black toner in the container 127BK is large. This is advantageous in extending a period for obtaining the effect of suppressing noise resulting from rotation of the motor 41. Further, since the rotation speed of the motor 41 can be stepwise decreased, it is possible to significantly suppress noise resulting from rotation of the motor 41, once the amount of black toner in the container 127BK is decreased to a certain degree.

The second modification is as follows. The image forming apparatus is further provided with a second storage portion which stores in advance data in which the value of a counter electromotive voltage and the third speed are correlated with each other in such a manner as to satisfy a relation that the third speed increases, as the absolute value of a counter electromotive voltage value measured by the counter electromotive voltage measuring portion 42 is decreased. The motor control portion 43 performs a speed change control of increasing the third speed after the absolute value of a counter electromotive voltage value measured by the counter electromotive voltage measuring portion 42 is smaller than the second value, with use of the data stored in the second storage portion and the counter electromotive voltage value measured by the counter electromotive voltage measuring portion 42, in the case where the receiving portion 44 receives a designation of switching to a high speed.

Now, let us consider a configuration of switching the rotation speed of the motor 41 from the first speed to the third speed, and thereafter, retaining the third speed unchanged. In the case where the rotation speed of the motor 41 is switched to the third speed in a state that the amount of black toner in the container 127BK is large, it is possible to obtain the effect of enhancing the replenishing speed of black toner from the state that the amount of black toner in the container 127BK is large. Accordingly, the period for obtaining the effect can be extended. However, since load torque of the motor 41 is large in a state that the amount of black toner in the container 127BK is large, it is impossible or difficult to increase the third speed in the state that the amount of black toner in the container 127BK is large. Thus, it is impossible to greatly enhance the replenishing speed of black toner.

On the other hand, in the case where the rotation speed of the motor 41 is switched to the third speed in a state that the amount of black toner in the container 127BK is small, load torque of the motor 41 is small in the state that the amount of black toner in the container 127BK is small. Accordingly, it is possible to increase the third speed, which makes it possible to greatly enhance the replenishing speed of black toner. However, the period for obtaining the effect of enhancing the replenishing speed of black toner is short, because the effect is obtained only after the amount of black toner in the container 127BK is decreased to a certain degree.

In contrast, according to the second modification, it is possible to stepwise increase the third speed, as the absolute value of a counter electromotive voltage value measured by the counter electromotive voltage measuring portion 42 is decreased. Thus, it is possible to switch the rotation speed of the motor 41 to the third speed from a state that the amount of black toner in the container 127BK is large. This is advantageous in extending a period for obtaining the effect of enhancing the replenishing speed of black toner. Further, since the rotation speed of the motor 41 can be stepwise increased, it is possible to significantly enhance the replenishing speed of black toner, once the amount of black toner in the container 127BK is decreased to a certain degree.

The third modification is as follows. The third modification has such a configuration that the image forming apparatus has a function of switching to a low speed, but does not have a function of switching to a high speed. The receiving portion 44 in FIG. 5 is operative to receive a designation of switching to a low speed i.e. switching the rotation speed of the motor 41 from the first speed to the second speed lower than the first speed in response to user's manipulation of the operation portion 400. In the case where the receiving portion 44 receives a designation of switching to a low speed, the motor control portion 43 performs a speed change control of causing the motor 41 to rotate at the first speed until the absolute value of a counter electromotive voltage value measured by the counter electromotive voltage measuring portion 42 becomes equal to or smaller than the predetermined first value, and causing the motor 41 to rotate at the second speed after the absolute value of a counter electromotive voltage value measured by the counter electromotive voltage measuring portion 42 is smaller than the first value.

The third modification may be applied to the first modification.

The third modification may be altered as follows. In the case where the receiving portion 44 has not received a designation of switching to a low speed resulting from user's non-manipulation of the operation portion 400, the motor control portion 43 may cause the motor 41 to rotate at the first speed, regardless of the magnitude of the absolute value of a counter electromotive voltage value measured by the counter electromotive voltage measuring portion 42.

The fourth modification is as follows. The fourth modification has such a configuration that the image forming apparatus has a function of switching to a high speed, but does not have a function of switching to a low speed. The receiving portion 44 in FIG. 5 is operative to receive a designation of switching to a high speed i.e. switching the rotation speed of the motor 41 from the first speed to the third speed higher than the first speed in response to user's manipulation of the operation portion 400. In the case where the receiving portion 44 receives a designation of switching to a high speed, the motor control portion 43 performs a speed change control of causing the motor 41 to rotate at the first speed until the absolute value of a counter electromotive voltage value measured by the counter electromotive voltage measuring portion 42 becomes equal to or smaller than the predetermined second value, and causing the motor 41 to rotate at the third speed after the absolute value of a counter electromotive voltage value measured by the counter electromotive voltage measuring portion 42 is smaller than the second value.

The fourth modification may be applied to the second modification.

The fourth modification may be altered as follows. In the case where the receiving portion 44 has not received a designation of switching to a high speed resulting from user's non-manipulation of the operation portion 400, the motor control portion 43 may cause the motor 41 to rotate at the first speed, regardless of the magnitude of the absolute value of a counter electromotive voltage value measured by the counter electromotive voltage measuring portion 42.

In the embodiment and in the first through fourth modifications as described above, a toner container body (the container 127Y, the container 127M, the container 127C, the container 127BK), the developing portion 121, the motor 41, the reverser voltage measuring portion 42, and the motor control portion 43 are provided for each of toners of four different colors (yellow, magenta, cyan, and black) for use in color printing. In the case where the receiving portion 44 receives a designation of switching to a low speed, each of the motor control portions 43 performs the speed change control to be implemented in the case where switching to a low speed is designated; and in the case where the receiving portion 44 receives a designation of switching to a high speed, each of the motor control portions 43 performs the speed change control to be implemented in the case where switching to a high speed is designated.

Now let us describe an operation to be performed in the case where switching to a low speed is designated. In the case where the receiving portion 44 receives a designation of switching to a low speed, specifically, in the case where the absolute value of a counter electromotive voltage value measured by the counter electromotive voltage measuring portion 42 allocated to e.g. yellow toner is smaller than the first value, the motor control portion 43 allocated to yellow toner switches the rotation speed of the motor 41 from the first speed to the second speed. The motor control portions 43 allocated to toners of the remaining colors (magenta, cyan, and black) cause the respective corresponding motors 41 to rotate at the first speed. Then, in the case where the absolute value of a counter electromotive voltage value measured by the counter electromotive voltage measuring portion 42 allocated to e.g. black toner is smaller than the first value in the above state, the motor control portion 43 allocated to black toner switches the rotation speed of the motor 41 from the first speed to the second speed. Then, the motor control portions 43 allocated to the toners of the remaining colors (magenta and cyan) cause the respective corresponding motors 41 to rotate at the first speed.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus constructed in such a manner that a toner containing body incorporated with a toner feeding mechanism is dismountably mounted, comprising:

a developing portion which develops an electrostatic latent image by toner, the toner being replenished from the toner containing body by operating the toner feeding mechanism;

a motor which generates a rotation driving force for operating the toner feeding mechanism;

an operation portion;

a receiving portion which receives a designation of switching to a low speed or switching to a high speed in response to manipulation of the operation portion, the switching to a low speed being switching a rotation speed of the motor from a first speed to a second speed lower than the first speed, the switching to a high speed being switching the rotation speed of the motor from the first speed to a third speed higher than the first speed;

a measuring portion which measures a value of a counter electromotive voltage or a value of a counter electromotive current generated in the motor by causing the motor to operate the toner feeding mechanism; and a motor control portion which is operable to:

(a) control the motor to rotate at the first speed until an absolute value of the value measured by the measuring portion becomes equal to or smaller than a predetermined first value, and control the motor to rotate at the second speed after an absolute value of the value measured by the measuring portion becomes smaller than the first value, in the case where the receiving portion receives a designation of switching to a low speed; and (b) control the motor to rotate at the first speed until an absolute value of the value measured by the measuring portion becomes equal to or smaller than a predetermined second value, and control the motor to rotate at the third speed after an absolute value of the value measured by the measuring portion becomes smaller than the second value, in the case where the receiving portion receives a designation of switching to a high speed.

2. The image forming apparatus according to claim 1, further comprising:

a first storage portion which stores in advance data in which the value measured by the measuring portion and the second speed are correlated with each other in such a manner as to satisfy a relation that the second speed decreases, as the absolute value of the value measured by the measuring portion decreases, wherein the motor control portion performs a speed change control of decreasing the second speed after the absolute value of the value measured by the measuring portion becomes smaller than the first value, with use of the data stored in the first storage portion and the value measured by the measuring portion, in the case where the receiving portion receives the designation of switching to a low speed.

3. The image forming apparatus according to claim 2, further comprising:

a second storage portion which stores in advance data in which the value measured by the measuring portion and the third speed are correlated with each other in such a manner as to satisfy a relation that the third speed increases, as the absolute value of the value measured by the measuring portion decreases, wherein the motor control portion performs a speed change control of increasing the third speed after the absolute value of the value measured by the measuring portion becomes smaller than the second value, with use of the data stored in the second storage portion and the value measured by the measuring portion, in the case where the receiving portion receives the designation of switching to a high speed.

4. The image forming apparatus according to claim 1, further comprising:

a second storage portion which stores in advance data in which the value measured by the measuring portion and the third speed are correlated with each other in such a manner as to satisfy a relation that the third speed increases, as the absolute value of the value measured by the measuring portion decreases, wherein the motor control portion performs a speed change control of increasing the third speed after the absolute value of the value measured by the measuring portion becomes smaller than the second value, with use of the data stored in the second storage portion and the value measured by the measuring portion, in the case where the receiving portion receives the designation of switching to a high speed.

5. The image forming apparatus according to claim 1, wherein the image forming apparatus is operable to perform a color printing operation, the toner containing body, the developing portion, the motor, the measuring portion, and the motor control portion being provided for each of toners of different colors to be used in the color printing operation, each of the motor control portions performs the control (a), in the case where the receiving portion receives the designation of switching to a low speed, and each of the motor control portions performs the control (b), in the case where the receiving portion receives the designation of switching to a high speed.

6. The image forming apparatus according to claim 1, wherein the motor control portion causes the motor to rotate at the first speed, regardless of a magnitude of the absolute value of the value measured by the measuring portion, in the case where the receiving portion has not received the designation of switching to a low speed or the designation of switching to a high speed, resulting from non-manipulation of the operation portion.

7. The image forming apparatus according to claim 1, wherein the motor is a DC brush motor.

8. An image forming apparatus constructed in such a manner that a toner containing body incorporated with a toner feeding mechanism is dismountably mounted, comprising:

a developing portion which develops an electrostatic latent image by toner, the toner being replenished from the toner containing body by operating the toner feeding mechanism;

a motor which generates a rotation driving force for operating the toner feeding mechanism;

an operation portion;

a receiving portion which receives a designation of switching to a low speed in response to manipulation of the operation portion, the switching to a low speed being switching a rotation speed of the motor from a first speed to a second speed lower than the first speed;

a measuring portion which measures a value of a counter electromotive voltage or a value of a counter electromotive current generated in the motor by causing the motor to operate the toner feeding mechanism; and a motor control portion which performs a speed change control of causing the motor to rotate at the first speed until an absolute value of the value measured by the measuring portion becomes equal to or smaller than a predetermined first value, and causing the motor to rotate at the second speed after an absolute value of the value measured by the measuring portion becomes smaller than the first value, in the case where the receiving portion receives the designation of switching to a low speed.

9. The image forming apparatus according to claim 8, further comprising:

a first storage portion which stores in advance data in which the value measured by the measuring portion and the second speed are correlated with each other in such a manner as to satisfy a relation that the second speed decreases, as the absolute value of the value measured by the measuring portion decreases, wherein the motor control portion performs a speed change control of decreasing the second speed after the absolute value of the value measured by the measuring portion becomes smaller than the first value, with use of the data stored in the first storage portion and the value measured by the measuring portion, in the case where the receiving portion receives the designation of switching to a low speed.

10. The image forming apparatus according to claim 8, wherein the image forming apparatus is operable to perform a color printing operation, the toner containing body, the developing portion, the motor, the measuring portion, and the motor control portion being provided for each of toners of different colors to be used in the color printing operation, and each of the motor control portions performs the speed change control, in the case where the receiving portion receives the designation of switching to a low speed.

11. The image forming apparatus according to claim 8, wherein the motor control portion causes the motor to rotate at the first speed, regardless of a magnitude of the absolute value of the value measured by the measuring portion, in the case where the receiving portion has not received the designation of switching to a low speed, resulting from non-manipulation of the operation portion.

12. The image forming apparatus according to claim 8, wherein the motor is a DC brush motor.

13. An image forming apparatus constructed in such a manner that a toner containing body incorporated with a toner feeding mechanism is dismountably mounted, comprising:

a developing portion which develops an electrostatic latent image by toner, the toner being replenished from the toner containing body by operating the toner feeding mechanism;

a motor which generates a rotation driving force for operating the toner feeding mechanism;

an operation portion;

a receiving portion which receives a designation of switching to a high speed in response to manipulation of the operation portion, the switching to a high speed being switching a rotation speed of the motor from a first speed to a third speed higher than the first speed;

a measuring portion which measures a value of a counter electromotive voltage or a value of a counter electromotive current generated in the motor by causing the motor to operate the toner feeding mechanism; and a motor control portion which performs a speed change control of causing the motor to rotate at the first speed until an absolute value of the value measured by the measuring portion becomes equal to or smaller than a predetermined second value, and causing the motor to rotate at the third speed after the absolute value of the value measured by the measuring portion becomes smaller than the second value, in the case where the receiving portion receives the designation of switching to a high speed.

14. The image forming apparatus according to claim 13, further comprising:

a second storage portion which stores in advance data in which the value measured by the measuring portion and the third speed are correlated with each other in such a manner as to satisfy a relation that the third speed increases, as the absolute value of the value measured by the measuring portion decreases, wherein the motor control portion performs a speed change control of increasing the third speed after the absolute value of the value measured by the measuring portion becomes smaller than the second value, with use of the data stored in the second storage portion and the value measured by the measuring portion, in the case where the receiving portion receives the designation of switching to a high speed.

15. The image forming apparatus according to claim 13, wherein the image forming apparatus is operable to perform a color printing operation, the toner containing body, the developing portion, the motor, the measuring portion, and the motor control portion being provided for each of toners of different colors to be used in the color printing operation, and each of the motor control portions performs the speed change control, in the case where the receiving portion receives the designation of switching to a high speed.

16. The image forming apparatus according to claim 13, wherein the motor control portion causes the motor to rotate at the first speed, regardless of a magnitude of the absolute value of the value measured by the measuring portion, in the case where the receiving portion has not received the designation of switching to a high speed, resulting from non-manipulation of the operation portion.

17. The image forming apparatus according to claim 13, wherein the motor is a DC brush motor.

* * * * *